US005463218A

United States Patent [19]

Holle

[11] Patent Number: 5,463,218

[45] Date of Patent: Oct. 31, 1995

[54] DETECTION OF VERY LARGE MOLECULAR IONS IN A TIME-OF-FLIGHT MASS SPECTROMETER

[75] Inventor: Armin Holle, Oyten, Germany

[73] Assignee: Bruker-Franzen Analytik GmbH, Bremen, Germany

[21] Appl. No.: 245,958

[22] Filed: May 19, 1994

[30] Foreign Application Priority Data

May 19, 1993 [DE] Germany ..... 43 16 805.1

[51] Int. Cl.[6] ..... H01J 49/26

[52] U.S. Cl. ..... 250/281; 250/283

[58] Field of Search ..... 250/281, 283, 250/282, 397, 299, 292

[56] References Cited

U.S. PATENT DOCUMENTS

| | | | |
|---|---|---|---|
| 4,267,448 | 5/1981 | Feser et al. | 250/283 |
| 4,322,629 | 3/1982 | Eloy et al. | 250/299 |
| 4,988,867 | 1/1991 | Laprade | 250/283 |
| 4,988,868 | 1/1991 | Gray | 250/281 |
| 5,202,561 | 4/1993 | Giessmann et al. | 250/287 |

FOREIGN PATENT DOCUMENTS

| | | |
|---|---|---|
| 0278034 | 8/1988 | European Pat. Off. . |
| 4129791 | 9/1991 | Germany . |
| 2233147 | 5/1989 | United Kingdom . |

OTHER PUBLICATIONS

Boesl, et al. Mass Resolution of 10,000 in a Laser Ionization Time–of–Flight Mass Spectrometer, Int. Journal of Mass Spectronomy and Ion Processes, 71 (1986) 309–313, Elsevier Science Publishers B.V. Amsterdam.

Karas et al. Laser Desportion Ionization of Proteins with Molecular Masses, Anal., Chem 1988, 60, pp. 2299–2301.

Tanaka et al., Protein and Polymer Analyses up to m/z 100 000 by Laser Ionization Time–of–Flight Mass Spectr., Rapid Comm. in Mass Spectr., vol. 2, No. 8, 1988.

Electron and Ion Conversion from Large Molecular Ions Incidsent on Various Surfaces, J. Martens, et al. University of Manitoba.

The Analysis of Water–Soluble Polymers by Matrix–Assisted Laser Desorption Time–of–Flight, OMS Letter, Organic Mass Spec vol. 27, 843–846, 1992.

Time–of–Flight Spectrometer for Mass Identification of Heavy Ions, Dietz et al., pp. 581–586, Nuclear Instr. & Methods, 97.

Characteristics of a Multichannel Electrooptical Detection System and its Application to the Analysis of Large Molecules by Fast Atom Bombardment of Mass Spectrometry, Anal. Chem. 1987, 59, 1990–1995, Cottrell et al.

*Primary Examiner*—Jack I. Berman
*Assistant Examiner*—James Beyer
*Attorney, Agent, or Firm*—Bookstein & Kudirka

[57] ABSTRACT

The invention relates to a method and a device for detecting very large molecular ions in a time-of-flight mass spectrometer, in which the molecules to be detected first fall with high energy (>8 keV) onto a conversion dynode and are then converted into an electronic signal in a sequence of stages. The rnolecules to be detected are at least partly converted into small (<200 u) positive and negative secondary ions on the conversion dynode. The secondary ions formed are accelerated, optionally positive or negative, onto a microchannel plate, where they are converted into electrons. The electrons are amplified in the microchannel plate and then accelerated onto a scintillator. The electron signal is converted into a light signal in the scintillator, being further amplified. A connecting fiber-optic light guide supplies the photons to a photomultiplier, in which they are converted in customary manner into a signal which can be evaluated electronically.

22 Claims, 1 Drawing Sheet

DETECTION OF VERY LARGE MOLECULAR IONS IN A TIME-OF-FLIGHT MASS SPECTROMETER

FIELD OF THE INVENTION

The invention relates to a method and a device for detecting heavy molecular ions with masses >10,000 u and energies >8 keV in a time-of-flight mass spectrometer, in which the molecular ions to be detected generate lighter secondary ions by impinging on a conversion dynode. These secondary ions are first converted in subsequent multiplier stages into electrons and then into an electronic signal.

BACKGROUND OF THE INVENTION

A method of this kind and a device are, for example, known from the publication "Methods of Enzymology", Vol. 193, pp. 280 (1990) by F. Hillenkamp and M. Karas or also from M. Karas and F. Hillenkamp, Anal. Chem. 60, 2299 (1988).

The time-of-flight mass spectrometer (TOF=time-of-flight) is based on measurements of the ions time of flight. In addition to other effects, the mass resolution for an instrument of this kind is limited by time smearing of the signal by the ion detector during detection. For this reason, so-called microchannel plate detectors are customarily used. These typically consist of microchannels lying side by side with a diameter of approximately 10 μm. These channels are arranged at an angle of approximately 10° to the surface normal. An arrangement of this kind provides a detection-sensitive surface which is flat except for low penetration depth and aligned vertically to the ion beam so that practically no differences in the time of flight arise before detection. In addition, the design is very short (typically 0.5 mm) so that the total time of flight of the converted electrons is extremely brief and so that the time smearing is also very small. It has been possible to measure peak widths of <2.5 ns in a time-of-flight mass spectrometer with detectors of this kind (K. Walter, U. Boesl and E. W. Schlag, Int. Journ. Mass Spec. Ion Procs. 71 (1986) 309–313).

The detection of ions in a microchannel plate detector is based on the fact that the ions are "converted" into electrons on falling onto the surface of the detector and that these are then therefore "amplified" in the microchannels, i.e. multiplied as in a usual secondary-emission multiplier.

Since the introduction of matrix-assisted laser desorption ("MALD"; M. Karas and F. Hillenkamp, Anal. Chem. 60, (1988) 2299; K. Tanaka et al. Rapid Commun. Mass Spectrom. 2, (1988) 151) as a technique for generating ions with a very large mass-to-charge ratio (m/q), there has been a tremendous increase in interest in the effective detection of ions in the mass range with m/q up to 500,000 and above.

The microchannel plate detector has, however, two major disadvantages for this application:

1. It can be easily saturated. With a great amount of signal in a small mass range (approx. 20,000 to 200,000 ions/cm$^2$), e.g. from matrix ions, from much chemical background or from polymers, in which ions are distributed over a very wide mass range, the detection sensitivity for very large masses sinks to zero.

2. Large molecules more readily generate secondary ions instead of secondary electrons. For larger masses, the probability to convert to $e^-$ drops and becomes very small, as demonstrated by J. Martens, W. Ens and K. G. Standing in "Proceedings of the ASMS 1991" with a mass of 66,000 u.

Instead of $e^-$, both positive and negative secondary ions are readily generated. Our own examinations have shown that particularly the negative secondary ions of negative primary ions provide clearly improved signals in the detection of negative polymer ions of high molecular weight.

Until now the disadvantages stated above have either been accepted, or a secondary-emission multiplier with a first dynode some distance away was used, on which secondary ions are produced by conversion which are then accelerated onto the second dynode, there generating electrons which are afterwards amplified in a multiplier as usual. In contrast to a standard secondary-emission multiplier, a voltage of several kilovolts is applied between the first and second dynodes to enable the secondary ions produced at the first dynode to receive sufficient energy to generate secondary electrons on falling onto the second dynode in the papers quoted above, matrix-assisted laser desorption was carried out with a detector of this kind. It has a good sensitivity for molecules with large m/z owing to the conversion into small secondary ions at the first dynode and is more insensitive to saturation than a microchannel plate detector. The disadvantages are as follows:

1. The time resolution of the detector and thus the mass resolution of the mass spectrometer are poor. There are two reasons for this: a) The usual dynodes used (Venetian blind type) have a thickness of typically 4 mm. Depending on the point at which the ions fall onto the dynodes arranged at approx. 45°, the flight route is up to 4 mm longer. With a flight tube length of 1 m this results in a time inaccuracy (dt) of 0.4% of the total time (T). The resolution (R) is defined as R=T/2dt, this fact limiting the resolution to R< 125. b) The secondary ions generated at the conversion dynode are accelerated onto the next dynode which also has a thickness of 4 mm. This again results in a time smearing in the detection of the secondary ions. In addition, the secondary ions have a mass distribution from mass I ($H^-$) to approx. mass 100 (B. Spengler et al., Proceedings of the 38th ASMS Conference on Mass Spectrometry and Allied Topics (1990), pp. 162). This results in a further time smearing since the small secondary ions are accelerated more quickly onto the next dynode.

2. The detection of negative secondary ions is not possible since the uppermost dynodes have negative high voltage, e.g. −3 kV, if the signal output and thus the further amplifier electronics are required to have ground potential.

Therefore, it is among the objects of the invention to develop a method of detection and a detector for a time-of-flight mass spectrometer which is still suitable for large molecules (m>10,000 u) and enables the detection of positive and negative secondary ions.

SUMMARY OF THE INVENTION

In accordance with the present invention, this object is achieved by the secondary ions generating electrons in a microchannel plate in a first amplification stage, these generating photons in a scintillator in a second stage, and by detecting the photons with a photomultiplier in a third stage.

As before the primary ions are first converted into secondary ions since, compared with direct conversion into electrons, a detection method of this kind has a considerably higher sensitivity for large molecules. Here, it must be possible to subsequently detect positive or negative secondary ions since both types have decisive advantages depending on the application. The object of the invention is achieved by optically decoupled detection of the electrons which are amplified in the microchannel plate, enabling the detection electronics for both polarities of the secondary ions to be kept at ground potential.

The conversion dynode, onto which the primary ions fall, is preferably put at approximately the same potential as the field-free drift route of the time-of-flight mass spectrometer.

This has the advantage that the zero potential within the flight route is not disturbed by detector fields. If the conversion dynode is put at a potential which differs distinctly from the potential of the drift route, a grid must be fitted between the conversion dynode and the flight route, which is at the potential of the flight route. An arrangement of this kind has the essential disadvantage that secondary ions are already produced at the grid, which are accelerated very quickly onto the conversion dynode by the electrical field between the grid and the conversion dynode, i.e. at a different time to that at which the primary ions fall onto the conversion dynode, thus causing a time smearing of the signal.

The secondary ions resulting at the conversion dynode are typically accelerated onto the microchannel plate, imparting an energy of 4 keV for detection. For the detection of positive secondary ions, a potential of −4 kV is therefore applied to the upper surface of the microchannel plate and a potential of +4 kV applied in the case of negative secondary ions. This has the advantage that the secondary ions have sufficient energy to efficiently generate electrons on falling onto the microchannel plate.

The lower surface of the microchannel plate is put at an approximately 500 V higher potential, i.e. −3.5 kV for positive secondary ions and +4.5 kV for negative secondary ions. This has the advantage that amplification of the microchannel plate is low and the cross current over the microchannel plate is only small, thus avoiding saturation.

To detect the electrons leaving the microchannel plate, an energy of typically 10 keV is required in order to obtain sufficient photons per electron and in order to penetrate the aluminum layer on the scintillator. This results in a voltage of +15 kV for negative secondary ions and a voltage of +7 kV for positive secondary ions on the surface of the scintillator.

The electrical potential applied to the microchannel plate and to the scintillator can preferably be switched in polarity for the detection of positive or negative secondary ions. This has the advantage that the optimal configuration can be set in a simple manner for the detection of each ion type.

To further avoid saturation effects, it is advantageous if, during signal conversion in the amplifier stages, at least one of the electrical potentials applied to the conversion dynode, the microchannel plate or the surface of the scintillator is switched to an unfavorable detection value for a limited time so that substantially fewer photons reach the photomultiplier during this limited time.

In a preferred embodiment, the distance between the conversion dynode and the microchannel plate is less than 3 mm, preferably less than 1 mm, and the thickness of the conversion dynode is less than 2 mm, preferably less-than 1 mm, This has the advantage that the flight route length of the primary ions has only an error of 1 mm, the place of origin of the secondary ions is precisely defined to within 1 mm, and the flight route of the secondary ions is very short, and thus the difference in the time of flight of secondary ions differing in mass is small. Consequently, the time behavior of the detector is clearly improved by these measures.

Also to avoid saturation effects, it is advantageous to operate the microchannel plate with an amplification factor between 10 and 100, this also being sufficient due to the further amplification stages. It is particularly preferred if, with this aim in view, all amplification stages are operated with an amplification which is clearly below the electronically maximum possible value at any one time it has been found that optimal operating conditions are achieved if the amplification remains at a factor of approximately 10 to 100 below the maximum value at any one time.

The aforementioned device is developed by the invention so that the signal electrons amplified in the microchannel plate are accelerated onto a scintillator by a further positive difference in high-voltage potential between the microchannel plate and the surface of the scintillator and converted in the latter into photons which are finally converted by means of a photomultiplier into an electrical signal approximately at ground potential which can be fed to an electronic evaluator.

The conversion dynode advantageously consists of thin sheets which are fitted at an angle of approximately 45° to the flight direction of the heavy molecular ions to be detected. The entire dynode is less than 2 mm thick, permitting a good resolution.

Due to the aforementioned measures, the detection of heavy molecular ions is insensitive to saturation as a result of the impact of small molecules, even with large amplification, and can have a dead time of <1 μs. Thus, for example, polymers with wide mass distributions and large mass can be measured with matrix-assisted laser desorption. The time response allows a resolution of approximately R=500 with a flight route of 1 m and a conversion dynode thickness of 1 mm.

The thin conversion dynode, together with the microchannel plate, ensures an optimal time response during the conversion and detection of secondary ions. The optical decoupling makes it possible to put the microchannel plate at any potential whatsoever, enabling both positive and negative secondary ions to be detected by simply switching over the potential. The detector comprises three successive amplifier stages, two of which fall within the optical decoupling unit. Each of these amplifier stages must be run only with low amplification (factor of 10–100 less than the maximum possible amplification), making the entire arrangement insensitive to saturation. Moreover, the last link of the chain is by nature relatively insensitive to saturation.

BRIEF DESCRIPTION OF THE DRAWINGS

Further advantages, features and details are stated in the description below, in which a particularly preferred embodiment is described in detail with references to the drawing which shows the following.

DETAILED DESCRIPTION OF ILLUSTRATIVE EMBODIMENTS

Figure 1:
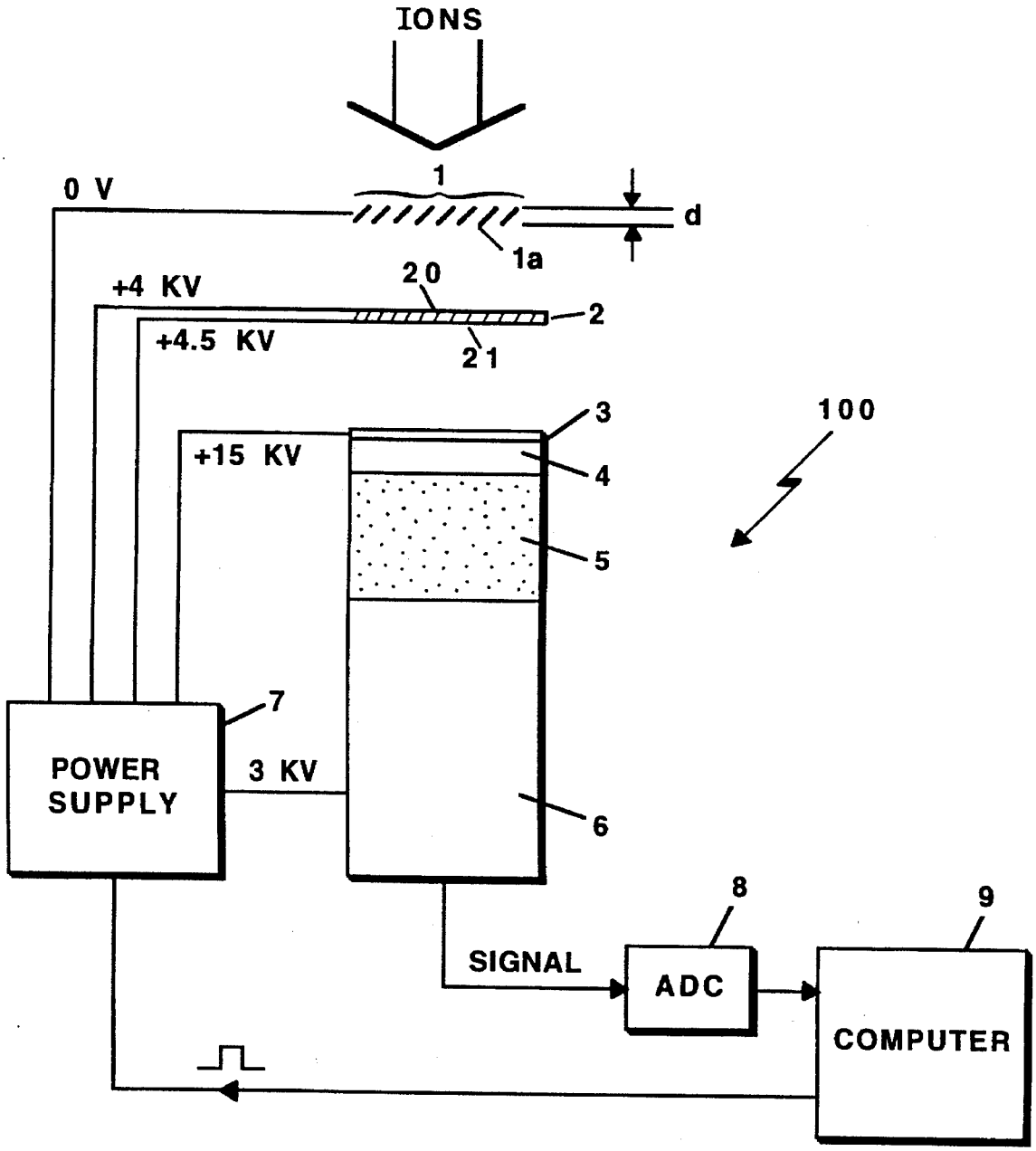
FIG. 1 is a schematic view of a detector according to the invention of a time-of-flight mass spectrometer, including high-voltage supply and detection electronics.

FIG. 1 shows a detector (100) according to the invention in schematic form. After traversing the flight route in the time-of-flight mass spectrometer (not shown), the heavy molecular ions to be detected fall onto the conversion dynode (1) of the detector (100), which is at an electrical potential of 0 V, with an energy >8 kV. To minimize the time smearing due to differing flight lengths, an extremely thin conversion dynode (1) is manufactured. With modern laser-cutting technology, a thickness (d) of 1 mm can be accomplished without difficulty, and even 0.5 mm is achievable. The dynode sheets (1*a*), which are approximately at 45° to the flight direction of the ions, have a thickness of 0.1 mm–0.2 mm or thinner. With a thickness of d=1 mm, a resolution of R=500 is possible and even a resolution of R=1,000 with a thickness of d=0.5 mm, the time-of-flight mass spectrometer having a typical flight tube length of 1 m.

The secondary ions generated are then accelerated onto the microchannel plate (2) which is at approximately –4 kV for the detection of positive secondary ions and approximately +4 kV for the detection of negative secondary ions, there being a difference in potential of approximately 500 V between the upper side (20) and underside (21), as marked in FIG. 1. The distance between the upper surface (20) of the microchannel plate (2) and the conversion dynode (1) is chosen to be as small as possible (approx. 1 mm), without flashover occurring. This minimizes time smearing during the acceleration of secondary ions of different masses. The microchannel plate (2) is operated only with low amplification (×10–×100) to avoid saturation and thus dead time. The essential function of the microchannel plate (2) is the accurately timed conversion of secondary ions into electrons.

The electrons are accelerated onto a very thin aluminum layer (3) (several 10 μm thick) which is at approximately 7 kV (in the case of positive secondary ions) or approximately 15 kV (in the case of negative secondary ions), penetrating it for the most part. The aluminum layer (3) vapor-deposited on the scintillator (4) serves only to create clear potential conditions since the scintillator (4) below is an insulator and therefore a charge would build up on its surface. Each electron is converted into approx. 1,000–3,000 photons in the scintillator (depending on the energy). Instead of the aluminum layer (3), a fine net is also conceivable.

The high voltages at surfaces 20, 21 and 3 are adjustable via the voltage supply (7), adjustment being controlled by a computer (9). In particular, they can be switched over to permit the detection of positive and negative secondary ions as required. The high voltage for the photomultiplier (6) is also adjustable.

The photons are conducted by a fiber-optic light guide (5) to a photomultiplier (6), where they are detected in the customary manner for photomultipliers and converted into an electrical signal (S) which is fed to the computer (9) via an ADC (8) for further processing. The fiber-optic light guide (5) can be made of the same material as the scintillator (4) so that a longer scintillator (4, 5) is simply used. The length of the scintillator (4, 5) is determined only by the distance necessary for insulating the 15 kV or 7 kV, 10 mm generally being sufficient. The photomultiplier (6) can be operated with low amplification and thus low noise since, on average, approx. $10^5$ to $10^6$ photons can be expected per primary ion to be detected due to the preceding amplification stages.

Using a detector (100) of this kind, we were able to measure, in our factory, polymer distributions with a mass of 170,000 u, as published in P. O. Danis et al., Organic Mass Spectrometry, OMS Letters, Vol. 27, (1992) 843 (there FIG. 2). Nothing concerning the detector's method of functioning was mentioned in the publication. These results are so far unique and could not be achieved with any other mass spectrometer. The success is essentially due to the great sensitivity and saturation insensitivity of the detector described here on the one hand and, on the other, the possibility of detecting negative secondary ions of negative primary ions.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A method for detecting heavy molecular ions with masses greater than 10,000 atomic mass units and energies greater than 8 keV in a time-of-flight mass spectrometer having a flight tube, comprising:

a) converting the heavy organic ions which pass through the flight tube of the spectrometer, into lighter, secondary particles consisting of positive and negative light ions and electrons, by impingement of the heavy ions on a venetian blind type conversion dynode with a maximum thickness of two millimeters;

b) accelerating a unipolar fraction of the lighter secondary particles towards a single microchannel plate located parallel to and not more than three millimeters from the conversion dynode by applying a first potential difference between the conversion dynode and a front side of the microchannel plate;

c) converting, on impingement of the surface of the microchannel plate, the accelerated secondary particles into electrons:

d) multiplying the number of electrons inside the microchannel plate, by applying a second potential difference between the front side of the microchannel plate and a back side of the microchannel plate;

e) accelerating electrons from the microchannel plate towards a scintillator by applying a second potential difference between the back side of the microchannel plate and the scintillator;

f) Converting the electrons to photons with the scintillator; and g) measuring the photons with a photomultiplier.

2. The method of claim 1 further comprising setting said conversion dynode to an electrical potential approximately equal to an electrical potential of the flight tube.

3. The method of claim 1 wherein applying the first potential difference comprises applying said first potential difference such that said first potential difference is switchable between two polarities to allow acceleration of positive and negative secondary ions.

4. The method of claim 1 wherein at least one of said electrical potentials is diminished for a limited time such that saturation effects in the microchannel plate and the photomultiplier are avoided.

5. The method of claim 1, wherein the distance between said conversion dynode and said microchannel plate is less than 1 mm.

6. The method of claim 1, wherein the thickness of said conversion dynode is less than 1 mm.

7. The method of claim 6, wherein the thickness of said conversion dynode is approximately 0.5 min.

8. The method of claim 1 further comprising the step of operating said microchannel plate with an amplification factor of between 10 and 100.

9. The method of claim 1 wherein an electron multiplication factor of the microchannel plate is between approximately 10 to 100 times below its maximum possible electron multiplication factor at any one time and an electron multiplication factor of the photomultiplier is between approximately 10 and 100 times below its maximum possible electron multiplication at any one time.

10. A device for detecting heavy molecular ions in a time-of-flight mass spectrometer comprising:

a conversion dynode operating at approximately ground potential, said conversion dynode at least partly converting molecular ions falling thereon into lighter secondary ions;

a microchannel plate operating at one of a positive and negative electrical highvoltage potential, said microchannel plate converting said secondary ions into signal electrons and amplifying said signal electrons, the microchannel plate being mounted parallel to the conversion dynode and being separated from the conversion dynode by a distance of not more than three millimeters;

a scintillator for converting said signal electrons into photons, said signal electrons amplified in said microchannel plate being accelerated onto said scintillator by a further positive difference in high-voltage potential between said microchannel plate and a surface of said scintillator; and a photomultiplier for converting said photons into an electrical signal approximately at ground potential for feeding to an electronic evaluator.

11. The device of claim 10, wherein said conversion dynode is at approximately the same electrical potential as a potential-free drift route of the time-of-flight mass spectrometer.

12. The device of claim 10, wherein the electrical high-voltage potential at said microchannel plate can be switched between a positive and a negative value.

13. The device of claim 12, wherein the electrical high-voltage potential at said surface of said scintillator can be switched between approximately 7 kV and approximately 15 kV.

14. The device of claim 10, wherein the distance between said conversion dynode and said microchannel plate is less than 1 mm.

15. The device of claim 10, wherein the thickness of said conversion dynode is less than 1 mm.

16. The device of claim 15, wherein the thickness of said conversion dynode is approximately 0.5 min.

17. The device of claim 10, wherein said conversion dynode comprises thin sheets fitted at an angle of approximately 45° to the flight direction of the molecular ions for detection, the entire conversion dynode being less than 2 mm thick.

18. The device of claim 10 wherein said conversion dynode is optically tight in the flight direction of the heavy organic ions and comprises thin sheets fitted at an angle of approximately 45° to said flight direction.

19. A device for detecting heavy molecular ions in a time-of-flight mass spectrometer having a flight tube, comprising:

a) a venetian blind type conversion dynode having a maximum thickness of approximately two millimeters;

b) a single microchannel plate mounted parallel to the conversion dynode and being separated from the conversion dynode by a distance of not more than three millimeters;

c) a first voltage supply, the output of which is connected to a front side of the microchannel plate;

d) a second voltage supply, the output of which is connected to a back side of the microchannel plate;

e) a scintillator with a metallized front side facing the back side of the microchannel plate;

f) a third voltage supply the output of which is connected to the front side of the scintillator;

g) a photomultiplier facing a back side of the scintillator;

h) power supply means for supplying power to the photomultiplier; and i) means for amplifying an output current of the photomultiplier.

20. The device of claim 19 wherein the conversion dynode and the flight tube are at approximately the same electrical potential.

21. The device of claim 20, wherein the first voltage supply can be switched a positive and a negative output voltage.

22. The device of claim 21 wherein the third voltage supply can be switched to deliver voltages of approximately 7 kV and approximately 15 kV.

* * * * *